US008127467B2

(12) United States Patent
Koyama

(10) Patent No.: US 8,127,467 B2
(45) Date of Patent: Mar. 6, 2012

(54) SOLE, AND FOOTWEAR PROVIDED WITH THE SAME

(75) Inventor: Yasushi Koyama, Tottori (JP)

(73) Assignee: World Wing Enterprise Co. (JP)

( * ) Notice: Subject to any disclaimer, the term of this patent is extended or adjusted under 35 U.S.C. 154(b) by 786 days.

(21) Appl. No.: 12/083,027

(22) PCT Filed: Jan. 10, 2007

(86) PCT No.: PCT/JP2007/050136
§ 371 (c)(1),
(2), (4) Date: Apr. 2, 2008

(87) PCT Pub. No.: WO2007/086251
PCT Pub. Date: Aug. 2, 2007

(65) Prior Publication Data

US 2009/0293307 A1 Dec. 3, 2009

(30) Foreign Application Priority Data

Jan. 26, 2006 (JP) ..... 2006-017396

(51) Int. Cl.
*A43B 13/00* (2006.01)

(52) U.S. Cl. ..... 36/25 R; 036/142; 036/103

(58) Field of Classification Search ..... 036/25 R, 036/31, 142, 143, 144, 103, 114, 88
See application file for complete search history.

(56) References Cited

U.S. PATENT DOCUMENTS 1,253,639 A 1/1918 Smith
(Continued)

FOREIGN PATENT DOCUMENTS

EP 1 346 655 A1 9/2003
(Continued)

*Primary Examiner* — Marie Patterson
(74) *Attorney, Agent, or Firm* — Gerald E. Hespos; Michael J. Porco

(57) ABSTRACT

A sole and footwear provided with such soles are capable of properly controlling the movement of a foot pressure center, using a simple configuration. This sole includes: a sole body (41) which forms each bottom part of the footwear; and a foot pressure protrusion portion (43) which is provided in this sole body (41), and guides a foot pressure center corresponding to the center of a pressure applied to the bottom of each foot that moves when a person walks or runs, along a predetermined foot pressure center route from the heel toward the vicinity of the root of the fourth toe.

20 Claims, 13 Drawing Sheets

U.S. PATENT DOCUMENTS

| | | | | |
|---|---|---|---|---|
| 1,984,989 | A * | 12/1934 | Reed | 36/8.3 |
| 2,139,263 | A * | 12/1938 | Fay | 36/148 |
| 2,650,438 | A | 9/1953 | Whitman | |
| 3,100,354 | A * | 8/1963 | Lombard et al. | 36/25 R |
| 3,958,578 | A * | 5/1976 | Tennant | 36/144 |
| 6,578,290 | B1 * | 6/2003 | Meynard | 36/103 |
| 6,920,707 | B1 | 7/2005 | Greene et al. | |
| 7,832,119 | B2 * | 11/2010 | Gilmore | 36/44 |
| 2002/0157279 | A1 | 10/2002 | Matsuura et al. | |
| 2003/0154628 | A1 * | 8/2003 | Gyr | 36/25 R |
| 2003/0208929 | A1 | 11/2003 | Lucas et al. | |
| 2007/0062065 | A1 * | 3/2007 | Wang et al. | 36/25 R |
| 2008/0127515 | A1 * | 6/2008 | Lohrer | 36/88 |

FOREIGN PATENT DOCUMENTS

| | | |
|---|---|---|
| GB | 234632 | 6/1925 |
| JP | 2003-93108 | 4/2003 |
| JP | 2005-185306 | 7/2005 |
| WO | WO 97/01295 | 1/1997 |
| WO | WO 02/058498 A1 | 8/2002 |

* cited by examiner

SOLE, AND FOOTWEAR PROVIDED WITH THE SAME

BACKGROUND OF THE INVENTION

1. Field of the Invention

The present invention relates to a sole which forms each bottom of footwear such as running shoes and walking shoes, and footwear provided with such soles.

2. Description of the Related Art

As a sole which forms each bottom of footwear, for example, Patent Document 1 discloses a sole which includes a mid-sole and a plurality of out-soles joined to the bottom surface of the mid-sole substantially over its whole area. Each out-sole is flat in the width directions thereof and becomes gradually thinner from the rear end toward the front end thereof.

In this sole according to Patent Document 1, when the out-soles touch the ground, then the center of gravity is guided forward and further ahead, thereby prompting the forward propulsion movement. This makes it possible to move the center of gravity smoothly in the front and back directions.

In general, a person walks or runs by landing in order from the heel toward the toes on the ground and leaving the ground successively from the heel toward the toes so that the center of gravity can be moved. It is known that at this time, a foot pressure center alike which corresponds to the center of a pressure applied to each foot bottom passes from the heel through the toes, especially the big toe pad. This foot pressure center's locus is an important element which represents the rightness of a walking or running motion.

However, in a pair of shoes provided with the soles according to Patent Document 1, when a person walks or runs with the shoes on, because the out-soles are joined over substantially the whole area of the mid-sole and are flat in the width directions, the foot pressure center passes on an individually different route in accordance with a personal walking or running motion. Hence, a desirable movement route of the foot pressure center is left out of account.

On the other hand, in recent years, how footwear affects the skeletal structure or muscles of a human body's lower half has increasingly become a matter of importance. At the same time, a variety of research and development has become active, aiming at a smooth and quick walking or running motion. There is a great demand for shoes or the like for making optimum walking and running motions.

It is an object of the present invention to provide a sole which is capable of properly controlling the movement of a foot pressure center using a simple configuration, and footwear provided with such soles.

SUMMARY OF THE INVENTION

The inventors have studies on optimum walking and running motions over a long period of time, and as a result, obtained the following knowledge. A person who wears footwear walks or runs by: landing from a heel region on the ground; moving a foot pressure center from this heel region toward the fourth toe; and lastly, passing it through the big toe pad. This makes it possible to lighten the burden imposed on the lower half body's skeletal structure or muscles as well as to make a smooth and swift walking or running motion. Especially, if the foot pressure center moves by way of the vicinity of the fourth toe's root as much as possible before it passes through the big toe pad on the front side of the foot bottom part, then an optimum motion can be made. The present invention relates to a footwear and a sole used for a footwear which are capable of, by devising the structure of the sole, easily realizing the above described optimum walking or the like only if a person wears it. Incidentally, the foot pressure center is a point of action of a floor reaction vector in a mean position where a floor reaction force acts.

Specifically, in order to solve the above described problems, a sole according to an aspect of the present invention is characterized by including: a sole body which forms each bottom part of footwear; and a foot pressure guidance portion which is provided in this sole body, and guides a foot pressure center corresponding to the center of a pressure applied to the bottom of each foot that moves when a person walks or runs, along a predetermined foot pressure center route from the heel toward the vicinity of the root of the fourth toe.

According to the present invention, the foot pressure guidance portion is provided in the sole body, so that the foot pressure center can be guided along a predetermined desirable foot pressure center route from the heel toward the vicinity of the root of the fourth toe when the person walks or runs. Specifically, regardless of the personal habit or the like of a wearer of footwear provided with such soles, when the wearer walks or runs, the foot pressure center can be guided from the heel to the vicinity of the root of the fourth toe. Thus, the wearer can move the thighs back and forth inward using the hip joint spontaneously and swing the legs and the foot bottom parts reflexively without tensing the muscles unnecessarily. This facilitates an optimum walking or running motion. Therefore, the burden imposed on the lower half body's skeletal structure or muscles becomes lighter, so that the wearer can walk or run stably, smoothly and swiftly, regardless of the habit of a walking or running motion.

DETAILED DESCRIPTION OF THE PREFERRED EMBODIMENTS

Hereinafter, preferred embodiments of the present invention will be described with reference to the drawings.

(First Embodiment)

Figure 1:
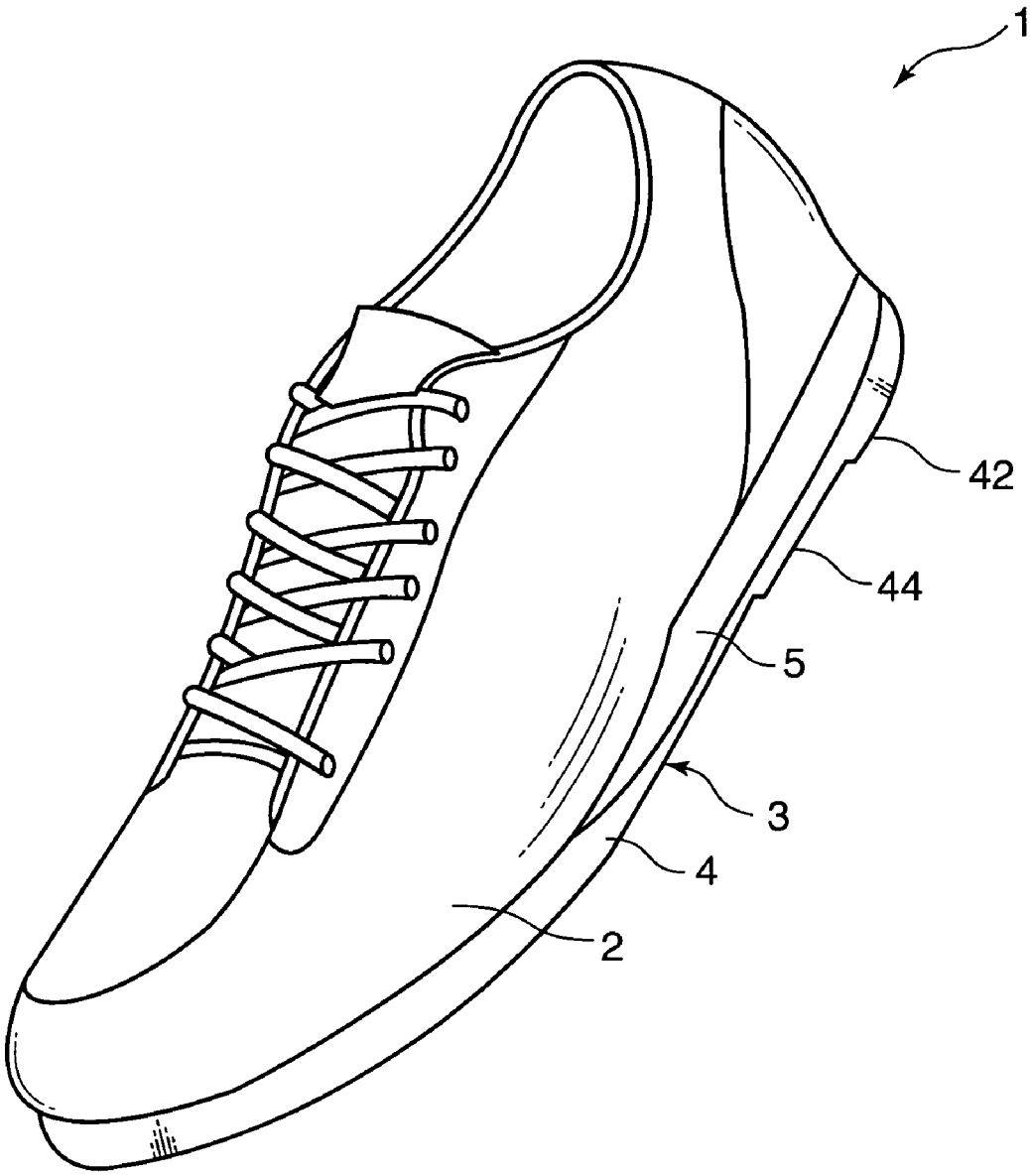
FIG. 1 is a schematic perspective view of a shoe according to a first embodiment of the present invention.
Figure 2:
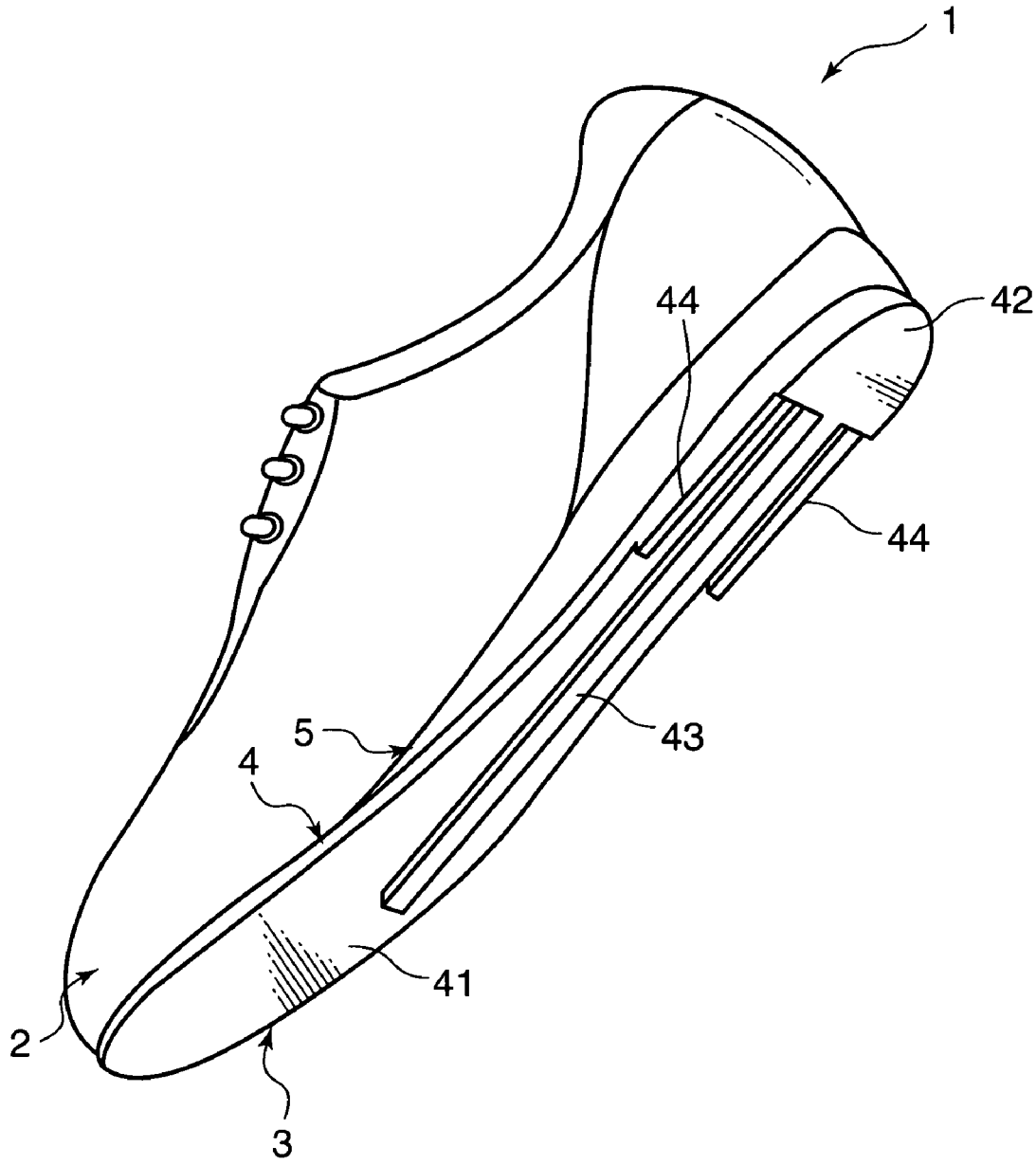
FIG. 2 is a schematic perspective view of the shoe, seen in a different direction from FIG. 1.

FIG. 1 is a schematic perspective view of a shoe (footwear) according to a first embodiment of the present invention. FIG. 2 is a schematic perspective view of the shoe, seen from a view point (i.e., the bottom surface side) different from FIG. 1. In this embodiment, a right shoe is given as an example, but a left shoe is only reversed right and left, and thus, has a specific configuration similar to the right shoe. The footwear according to the present invention and its sole can be broadly applied to running shoes, walking shoes, baseball shoes, soccer shoes and golf shoes, as well as well known footwear such as business shoes, mules and sandals.

Figure 3:
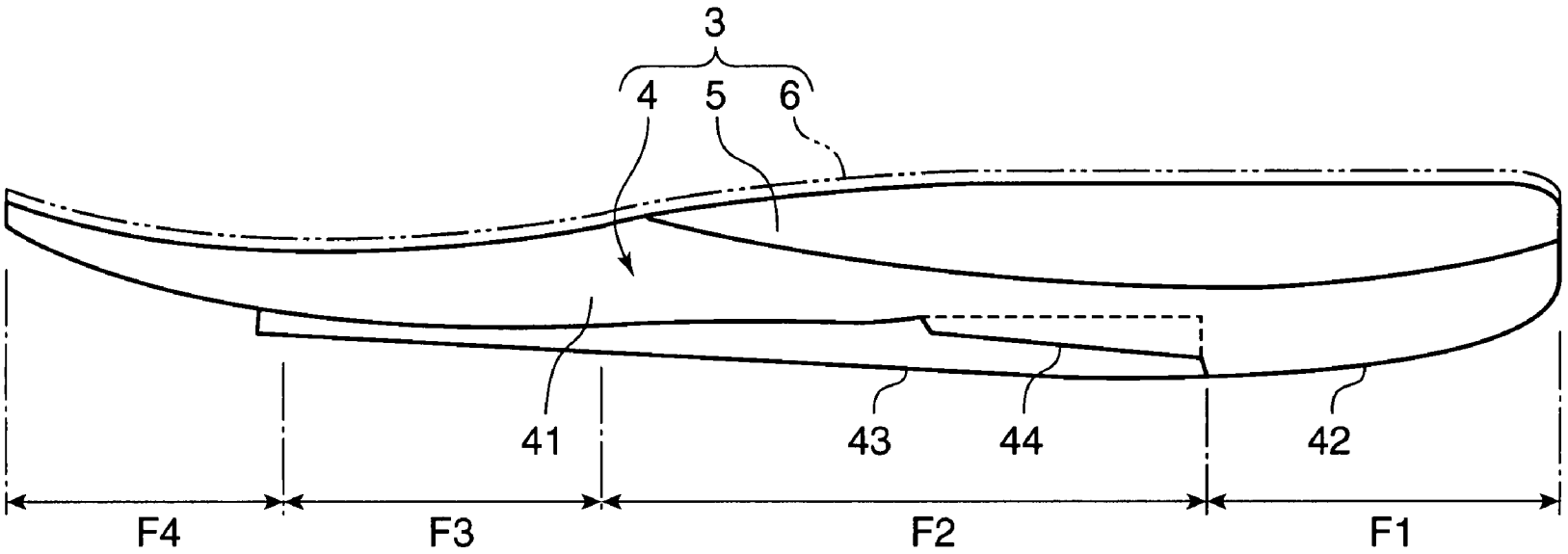
FIG. 3 is a side view of a sole according to the first embodiment of the present invention.
Figure 4:
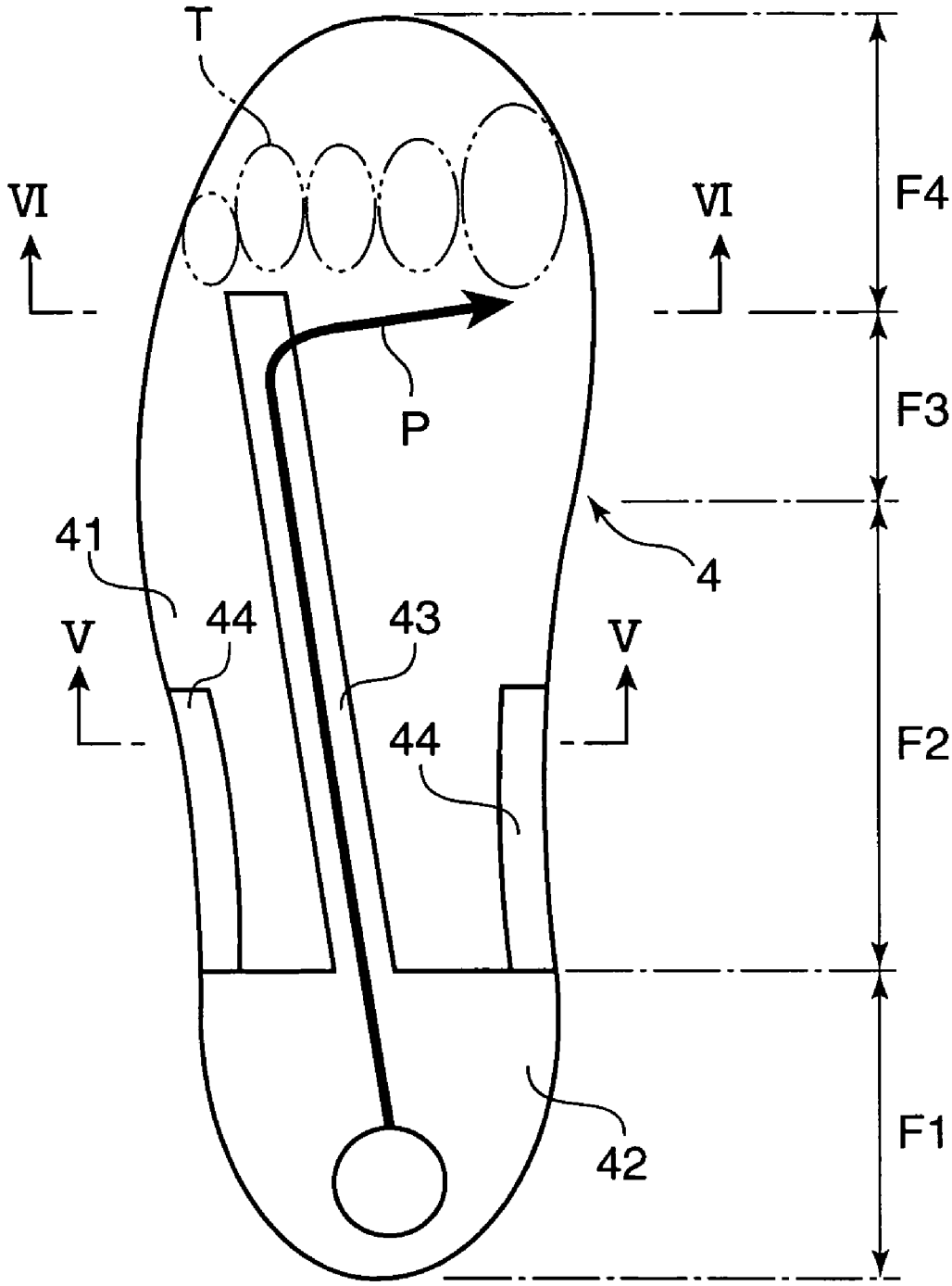
FIG. 4 is a typical bottom view of this sole.

This shoe 1 includes an upper 2 which covers the instep part of the foot region, and a sole 3 which is attached to a lower part of this upper 2 and forms the bottom part of the shoe 1. FIG. 3 is a side view of this sole 3 and FIG. 4 is a schematic bottom view of this sole 3.

The sole 3 includes an out-sole 4 whose bottom surface touches the ground, and a mid-sole 5 which is joined to the top surface of the out-sole 4 within the range from a heel region F1 to a foot arch region F2. On top of these, as shown by a double dashed chain line in FIG. 3, an in-sole 6 is provided.

The out-sole 4 is formed by integrally molding, for example, a material such as rubber, synthetic resin and elastomer. These materials may each be used alone, or may also be mixed or piled. Furthermore, use of a material such as a non foam or low foam one enhances the strength and the wear resistance of the out-sole 4. Moreover, though a detailed description is not given here, the out-sole 4 is suitably formed with a groove. This helps improve the design, as well as the drainage, the gripping force or the like.

This out-sole 4 is formed so that its bottom surface protrudes at a predetermined part thereof. Thereby, it is designed to guide, along this protrusion part, a foot pressure center corresponding to the center of a pressure applied to the bottom of each foot. Specifically, this out-sole 4 includes: a sole body 41 which corresponds to the foot region; a heel protrusion portion 42 (corresponding to the wide area protrusion portion) which protrudes downward in the heel region F1 of this sole body 41; a foot pressure protrusion strip 43 (corresponding to the foot pressure protrusion portion) which extends up to a toe region F4 from a substantially central part in the width directions at the front end of this heel protrusion portion 42; and a balance protrusion strip 44 (corresponding to the balance protrusion portion) which protrudes from a bottom surface of the sole body 41 on each side in the width directions on the base end side of this foot pressure protrusion strip 43. Thereby, it is designed to guide a desirable foot pressure center along the foot pressure protrusion strip 43 from the heel protrusion portion 42.

As described earlier, the sole body 41, the heel protrusion portion 42, the foot pressure protrusion strip 43, and the balance protrusion strip 44 are integrally molded out of some of the above described materials. In FIG. 3 and FIG. 4, the regions of F1 to F4 are a heel region F1, a foot arch region F2, a big toe pad region F3 and a toe region F4 of the out-sole 4, respectively.

Herein, in this specification, the heel region F1 is a region which corresponds substantially to the tarsal in the longitudinal directions; the foot arch region F2 is a region which corresponds substantially to the metatarsal in the longitudinal directions; the big toe pad region F3 is a region which corresponds substantially to the sesamoid bone at the front end part of the first metatarsal in the longitudinal directions; and the toe region F4 is a region which corresponds substantially to the pastern bone in the longitudinal directions.

With the above described mid-sole 5 placed on top of it, the sole body 41 is formed to be gradually thinner from a heel section to a toe section. Its toe region F4 is turned slightly upward. The bottom surface of the sole body 41 is flat and its heel region F1 is provided with the above described heel protrusion portion 42.

The area in which this heel protrusion portion 42 is provided is not especially limited, as long as it is the area which corresponds to the heel region F1. In this embodiment, it is provided over the entire area including a middle part of the heel region F1. In this way, the heel protrusion portion 42 is provided over the entire area including the middle part of the heel region F1 of the sole body 41, thereby making it possible to touch the ground in a relatively wide area at the time of a walking or running motion. This makes it possible to guide the foot pressure center smoothly to a middle part of the heel protrusion portion 42 and lead this foot pressure center easily to the foot pressure protrusion strip 43. Therefore, the foot pressure center can be guided in a stable state.

Incidentally, the formation position of the wide area protrusion portion according to the present invention is not especially limited, as long as it is the area which corresponds to the heel region F1 and the foot arch region F2. As can be seen in this embodiment, it may be provided over the whole heel region F1, or it may also be provided, for example, so that it includes the whole heel region F1 and its front end extends into the foot arch region F2.

The protrusion height of the heel protrusion portion 42 from the sole body 41 is not especially limited. Although it differs according to the purpose or specification (e.g., use on a lawn, a ground and a road) of footwear, for example, in the case of training shoes, it should preferably be set suitably within a range of 3 to 25 mm, or more desirably, 3 to 5 mm. Specifically, if this protrusion height is too small, it is difficult to lead the foot pressure center appropriately to the foot pressure protrusion strip 43 while cushioning an impact applied by a walking or running motion. In contrast, if this protrusion height is too great, then a person who wears the shoes tends to lose the balance so that the wearer could not walk or run smoothly.

Figure 5:
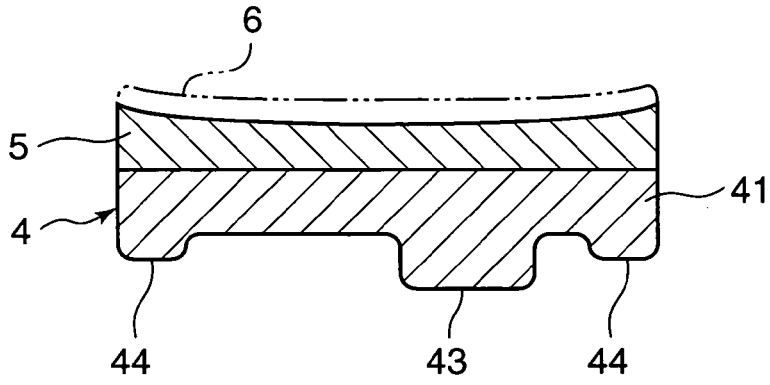
FIG. 5 is a sectional view of the sole, taken along the V-V line of FIG. 4.
Figure 6:
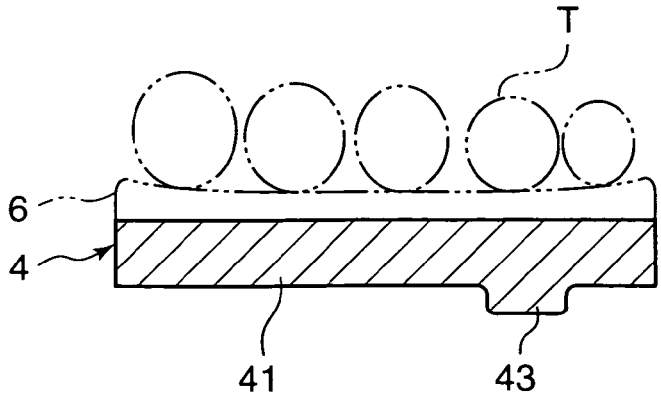
FIG. 6 is a sectional view of the sole, taken along the VI-VI line of FIG. 4.

The foot pressure protrusion strip 43 is provided in the bottom surface of the sole body 41 with protruding from it. This foot pressure protrusion strip 43 is formed by a protrusion strip which extends linearly and continuously toward a root of the fourth toe T from a substantially middle part of the heel protrusion portion 42 in the width directions. As shown in FIG. 5 and FIG. 6, it is shaped substantially like a trapezoid in sectional view. Specifically, the foot pressure protrusion strip 43 is configured so that its front end is located, as shown in FIG. 4, slightly on the heel section from the part which corresponds to the root of the fourth toe T. Thereby, the foot pressure center guided to its front end part is lead, as shown by an arrow P in FIG. 4, into the big toe pad region F3.

Herein, a front end of the foot pressure protrusion strip 43 is located around the root of the fourth toe T, so that the center of gravity can be stably moved and the stress on the joint region can be eased or eliminated. Specifically, if the front end of the foot pressure protrusion strip 43 is located further outward from the fourth toe T's root, for example, outward from the fifth toe (i.e., the little toe), then the force which will bring the person's body inside acts too early. Thereby, a foot joint and a hip joint are bent outward and a stress is given on the joint region of a toe, a foot joint or the like, thus causing hallux valgus. On the other hand, if the front end of the foot pressure protrusion strip 43 is disposed inward from the root of the fourth toe T, for example, the toe part around the second toe (i.e., the little toe), then the force which will bring the person's body outside acts greatly. Thereby, oppositely, the center of gravity becomes unstable, like swaying right and left, and a stress opposite to the above described stress on the joint region is applied to the joint region. Therefore, the front end of the foot pressure protrusion strip 43 needs to be located at the toe part around the root of the fourth toe T, so that the center of gravity can be stably moved and the stress on the joint region can be eased or eliminated.

Particularly, if the part of the foot pressure protrusion strip 43 which corresponds to the big toe pad region F3 and the toe region F4 extends substantially on the same line as the straight line between the middle part of the heel protrusion portion 42 and the root of the fourth toe T, then the above described advantage can be remarkably obtained.

The width of the foot pressure protrusion strip 43 is smaller than that of the heel protrusion portion 42 and is substantially fixed over its full length. Specifically, it has a width substantially equal to the width of the fourth toe T. In this foot pressure protrusion strip 43, on its base end part side (the heel region side), its protrusion height from the sole body 41 is substantially equal to the protrusion height of the heel protrusion portion 42. Thereby, its bottom surface is formed so as to continue to the bottom surface of the heel protrusion portion 42. Besides, the protrusion of the foot pressure protrusion strip 43 becomes gradually lower toward its front end side. In this embodiment, its protrusion height at the front end is designed to be approximately half of that at the base end part.

Incidentally, needless to say, the width and the protrusion height of the foot pressure protrusion strip 43 can be varied according to the purpose or specification of footwear. Its reduction rate by which it becomes gradually lower toward the front end side can be varied according to the purpose or the like.

In this way, the foot pressure protrusion strip 43 is narrower than the heel protrusion portion 42 and its bottom surface continues to this heel protrusion portion 42. Therefore, the foot pressure center which lies in the heel protrusion portion 42 is precisely lead to this foot pressure protrusion strip 43 and moves along the foot pressure protrusion strip 43. In other words, these heel protrusion portion 42 and foot pressure protrusion strip 43 forms a desirable foot pressure center route, so that the movement of the foot pressure center can be controlled in a simple manner.

The balance protrusion strip 44 is disposed, as shown in FIG. 4 and FIG. 5, on each side in the right and left directions at the base end part of the foot pressure protrusion strip 43. It is placed in both parts in the width directions on the bottom surface of the sole body 41, in such a manner that it protrudes from the sole body 41. This balance protrusion strip 44 is a protrusion strip for, at an early stage in the movement process of the foot pressure center, especially, when the foot pressure center shifts from the heel protrusion portion 42 to the foot pressure protrusion strip 43, returning this foot pressure center to the side of the foot pressure protrusion strip 43 if the foot pressure center deflects rightward or leftward from the foot pressure protrusion strip 43. Its protrusion is designed, as shown in. FIG. 5, to be a little lower than the foot pressure protrusion strip 43. In this balance protrusion strip 44 alike, its protrusion height is set to be gradually smaller toward the side of the foot arch region F2 from the side of the heel region F1. The reduction rate by which this protrusion becomes lower is set to be higher than that of the foot pressure protrusion strip 43. Hence, the difference in protrusion height between this balance protrusion strip 44 and the foot pressure protrusion strip 43 become gradually larger toward the toe section. In this way, the difference in protrusion height between protrusion strips 43, 44 becomes gradually larger toward the toe section, so that the foot pressure center can be more certainly lead to the foot pressure protrusion strip 43.

In addition, a pair of right and left balance protrusion strips 44 is both formed to continue to the heel protrusion portion 42. Then, they extend along each of the right and left side edges of the sole body 41, and their front ends are both located at a substantially middle part of the foot arch region F2. Each balance protrusion strip 44 has a fixed width in the longitudinal directions and is narrower than the foot pressure protrusion strip 43.

Incidentally, in this pair of internal and external balance protrusion strips 44, there is no need to true up their right and left front ends. For example, in longitudinal directions of the shoe, the internal balance protrusion strip 44 may be formed longer than the external balance protrusion strip 44.

Figure 7A:
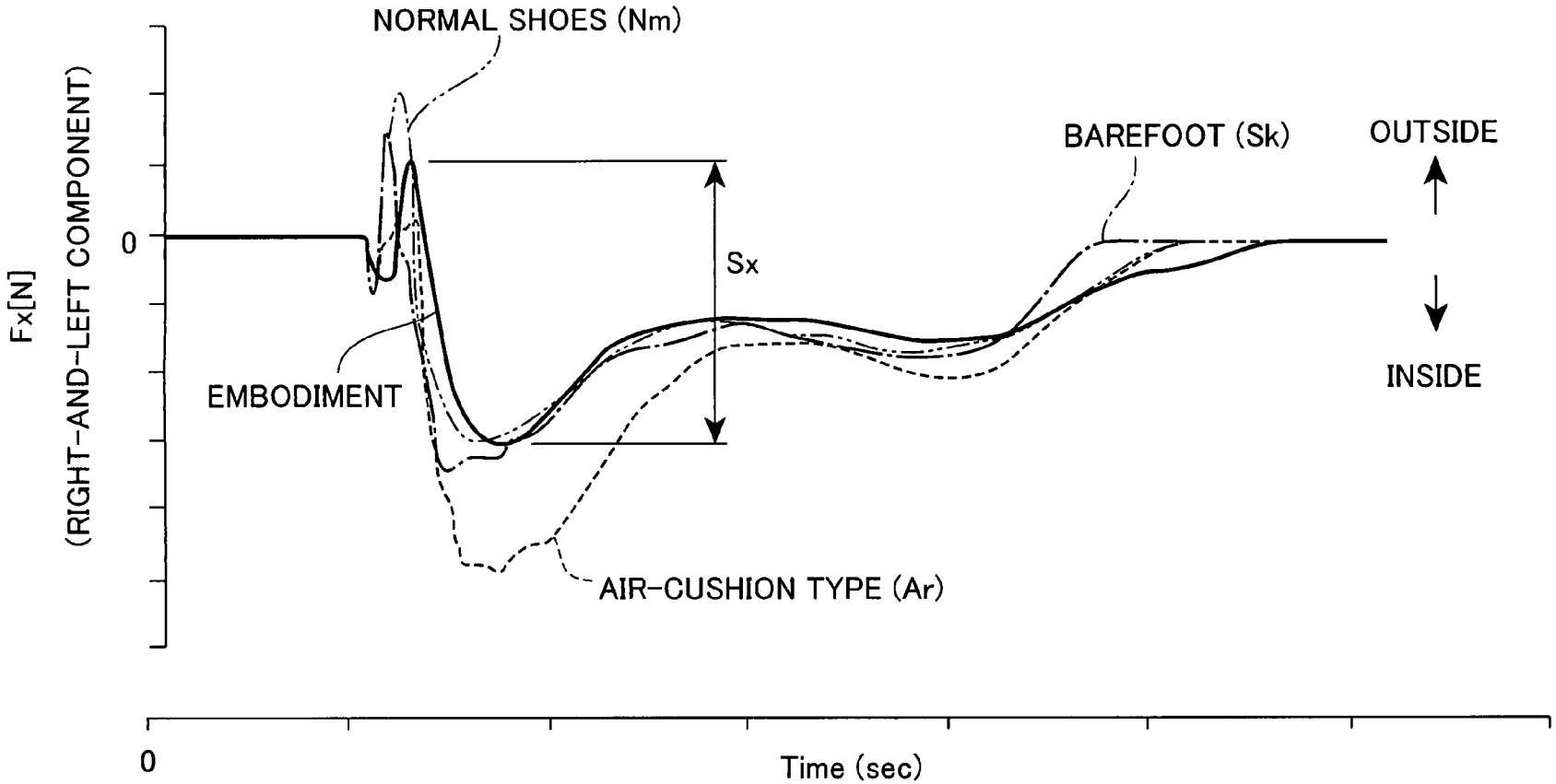
FIG. 7A is a graphical representation, showing floor reaction forces at the time of a walking motion.
Figure 7B:
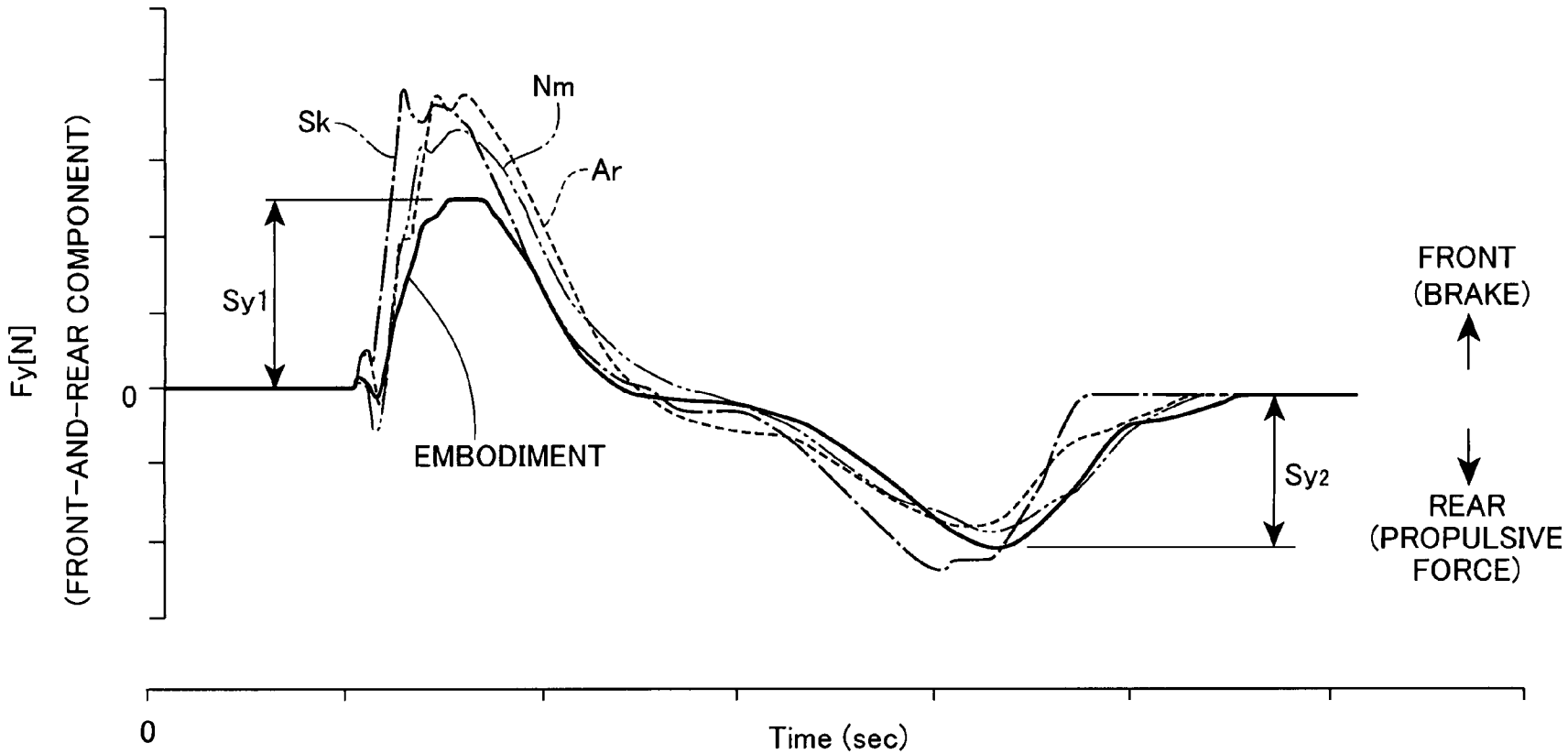
FIG. 7B is a graphical representation, showing floor reaction forces at the time of the walking motion.
Figure 7C:
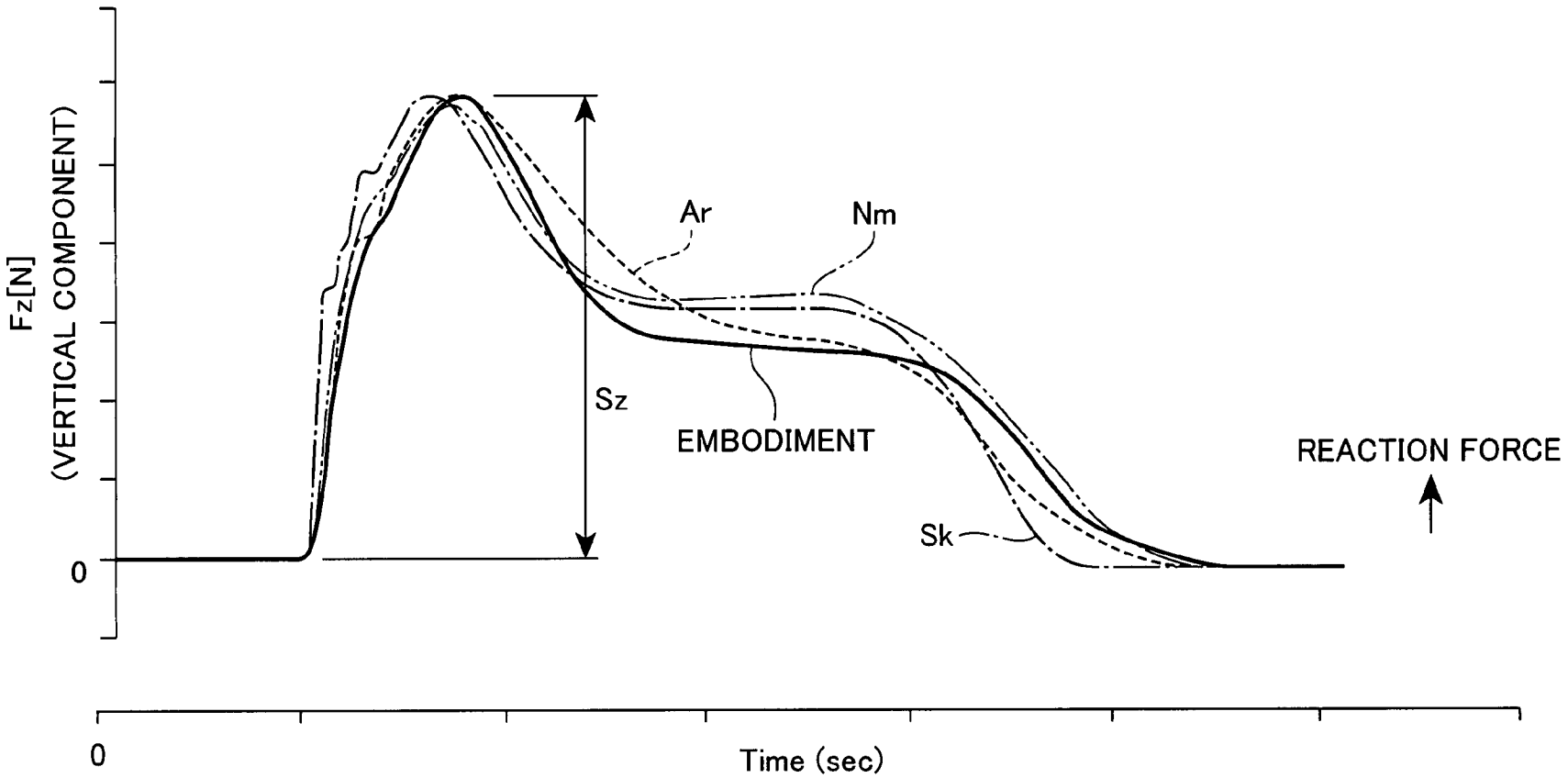
FIG. 7C is a graphical representation, showing floor reaction forces at the time of the walking motion.

In the case where a person who wears the shoe 1 having such a configuration as described so far makes a walking motion, each floor reaction force in the X, Y and Z directions (i.e., the foot width directions, the foot length directions and the foot vertical directions) is measured using a floor reaction force instrument. The result is shown in FIG. 7A to FIG. 7C. FIG. 7A shows a floor reaction force in the foot width directions (herein, the outside is positive); FIG. 7B shows a floor reaction force in the foot length directions (herein, the front side is positive); and FIG. 7C shows a reaction force distribution in the foot vertical directions (herein, the upside is positive). In addition to the measurement result of the floor reaction force in the case where the person walks with the shoe 1 according to this embodiment on, each figure also shows a measurement result in a case in which the person walks with normal shoes on, a case in which the person walks in a so called air cushion type shoes having an air cushion member embedded in its heel region, and further, a case in which the person walks barefoot.

As can be seen from this measurement result of the floor reaction force in FIG. 7A, in the case of bare feet and any such shoes, the foot pressure center deflects outward once, and then, sharply swings back inward. However, in the shoe 1 according to this embodiment, its deflection width Sx is smaller than any other case. Specifically, according to this measurement result, when the person has the shoe 1 according to this embodiment on and makes a walking motion or the like, the foot pressure center sways less laterally and moves more linearly. This indicates that the person can make a smooth and swift walking motion or the like. Besides, if the deflection width Sx is great, then in order to restrain this deflection, an excessive force works on the muscles or skeletal structure of the person's legs and loins. If this force is repeatedly applied, that can cause a backache or the like. Further, if this deflection width Sx becomes too great, that may trigger a sprain, a pulled muscle or the like. However, in terms of the shoe 1 according to this embodiment, the deflection width Sx can be kept down to a relatively small level. Consequently, there is no need to give too much of the strength to the legs and loins so that the sway can be restrained. Therefore, when the person walks or runs, the muscles can make a flexible and smooth motion. This helps effectively lighten the burden imposed on the muscles or skeletal structure of the legs and loins.

Furthermore, as can be seen from this measurement result of the floor reaction force in FIG. 7B, in any such case, a great reaction force acts in a moment when the shoe touches the ground while a reaction force in its opposite direction acts when the shoe separates from the ground. This floor reaction force when it leaves the ground works as a propulsive force. This indicates that the greater this reaction force becomes, the greater propulsive force will work. In view of this measurement result, it can be understood that when the person wears this shoe 1, a maximum floor reaction force Sy2 when it leaves the ground is desirable in the same way as the case of bare feet. In short, when the person wears the shoe 1 according to this embodiment, an excellent propulsive force can work.

On the other hand, attention should be paid here to the floor reaction force when the shoe touches the ground. Specifically, the floor reaction force when it touches the ground acts in the direction opposite to the floor reaction force when it separates from the ground. At the same time, it is a force which works in the vertical directions. Thereby, if this force becomes greater, that increases the power consumed in an up and down motion. In other words, the floor reaction force when it touches the ground acts as a brake on a propulsive force. Therefore, the greater this ground touching reaction force becomes, the propulsive force will be reduced. Simultaneously, this braking force contributes to imposing an excessive burden on the muscles or skeletal structure of the legs and loins. In this respect, when the person wears the shoe 1 according to this embodiment, a maximum floor reaction force Sy1 thereof is far weaker than that of any other case.

In brief, as can be seen from this measurement result of FIG. 7B, when the person wears the shoe 1 according to this embodiment, the damping motion is restrained as much as possible so that a propulsive force can be effectively produced. This makes it possible to walk or run smoothly and quickly. At the same time, the burden imposed on the muscles or skeletal structure of the legs and loins by an excessive braking force (or damping force) becomes extremely light. This helps restrain a hurt to the utmost.

Moreover, as can be seen from this measurement result of the floor reaction force in FIG. 7C, a maximum floor reaction force Sz when the person wears the shoe 1 according to this embodiment acts substantially similarly to the other cases. Taking into account this result of FIG. 7C together with the results of FIG. 7A and FIG. 7B, it can be found out that a propulsive force can be efficiently and smoothly produced with the same level of strength. Besides, this produced propulsive force enables the person to move the foot pressure center spontaneously without using unnecessary strength, in other words, restrain as much as possible the effect given the muscles or skeletal structure of the legs and loins.

In sum, in the out-sole 4 and the shoe 1 according to this embodiment, the heel protrusion portion 42 protrudes from the bottom surface of the heel region F1 of the sole body 41. Therefore, in a walking or running motion, first, this heel protrusion portion 42 is prompted to land on the ground. This heel protrusion portion 42 protrudes in a predetermined area including the middle part of the bottom surface of the heel region F1. Thereby, the foot pressure center can act first on the middle part of the heel region F1. Sequentially, the foot pressure protrusion strip 43 comes into contact with the ground, so that the foot pressure center can converge and act on this foot pressure protrusion strip 43. This makes it possible to concentrate the foot pressure center on the foot pressure center route.

Therefore, using a simple configuration where the foot pressure protrusion strip 43 protrudes from the bottom surface of the sole body 41, the foot pressure center can be guided along the predetermined foot pressure center route from the heel toward the vicinity of the root of the fourth toe. Specifically, regardless of the personal habit or the like of a wearer of this shoe 1, when the wearer walks or runs, the foot pressure center can always be guided from the heel to the vicinity of the root of the fourth toe. Then, a force for keeping the center of gravity inward works properly, thereby, the center of gravity is restrained to the utmost from swaying laterally and a propulsive force is efficiently transferred. At the same time, the wearer can move the thighs back and forth inward using the hip joint spontaneously and swing the legs and the foot bottom parts reflexively without tensing the muscles unnecessarily. This facilitates an optimum walking or running motion. Therefore, the burden imposed on the skeletal structure or muscles of the lower half body becomes lighter, so that the wearer can walk or run stably, smoothly and swiftly, regardless of how to walk or run.

In addition, movement of the foot pressure center along the arrow P of FIG. 4 prompts the foot muscles to become active well. This muscles activity can stimulate the brains and also improve a paralysis.

(Second Embodiment)

Figure 8:
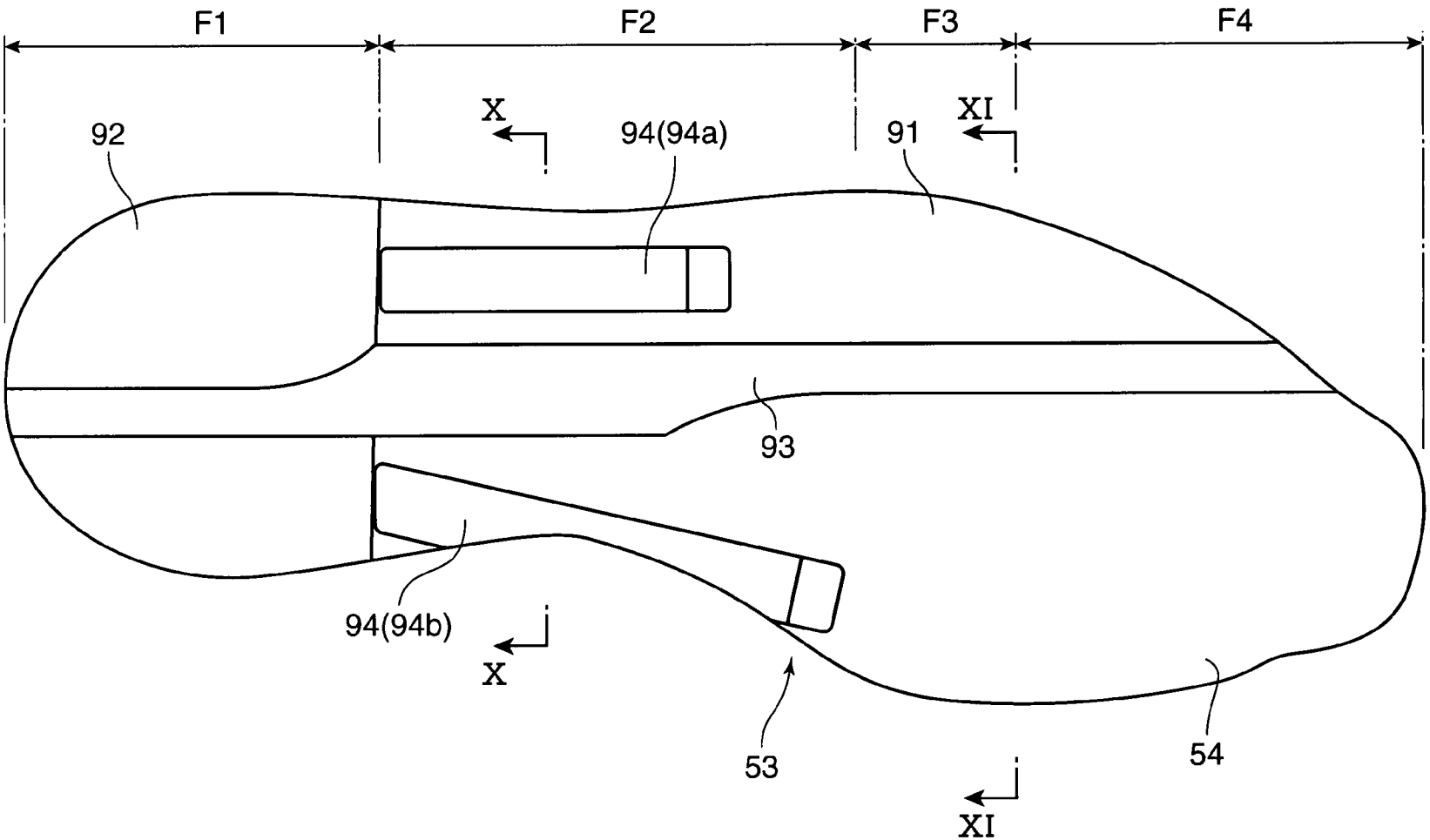
FIG. 8 is a schematic bottom view of a sole in a shoe according to a second embodiment of the present invention.
Figure 9:
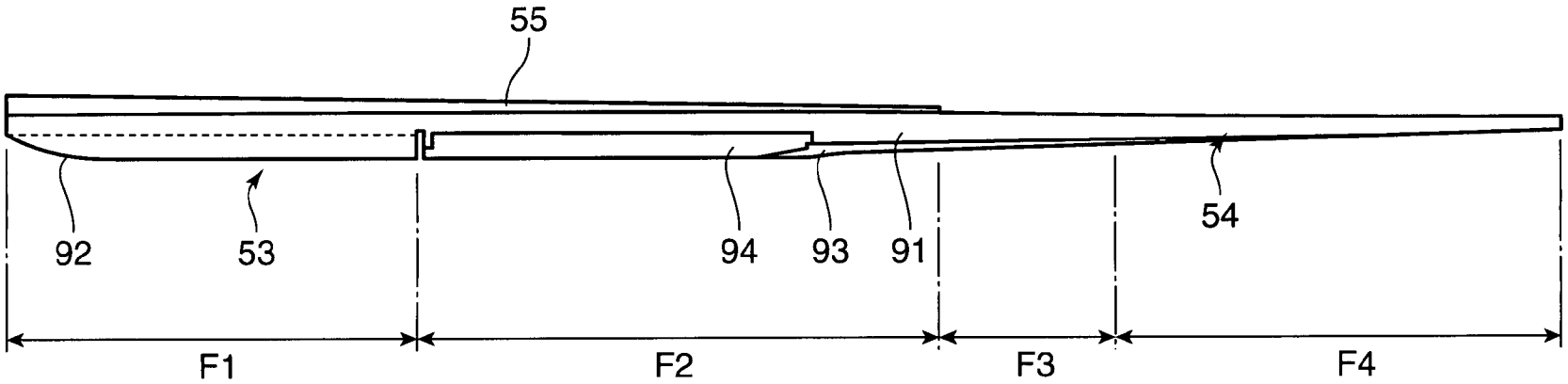
FIG. 9 is a side view of this sole, seen from the outside (the left hand side in FIG. 8).
Figure 10:
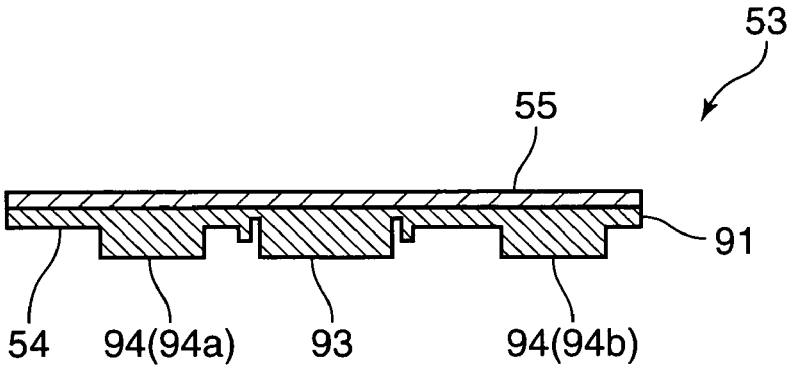
FIG. 10 is a sectional view of the sole, taken along the X-X line of FIG. 8.
Figure 11:
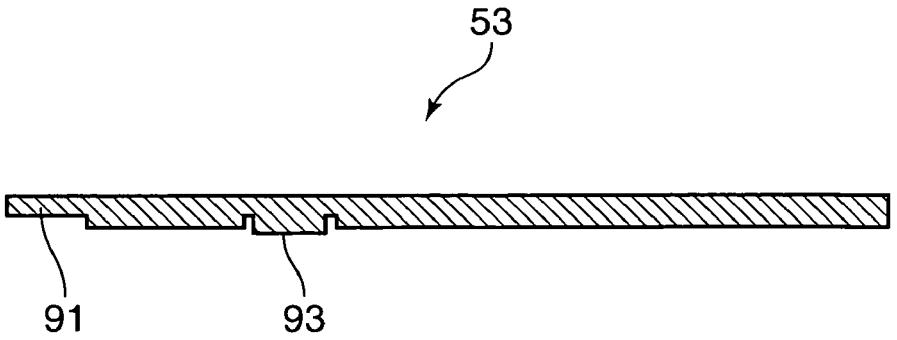
FIG. 11 is a sectional view of the sole, taken along the XI-XI line of FIG. 8.

Next, a shoe according to a second embodiment will be described with reference to FIG. 8 to FIG. 11. FIG. 8 is a schematic bottom view of a sole in the shoe according to the second embodiment. FIG. 9 is a side view of this sole, seen from the outside (the left hand side in FIG. 8). FIG. 10 and FIG. 11 are a sectional view of the sole, seen along the X-X line and the XI-XI line of FIG. 8, respectively.

A sole 53 of this shoe according to the second embodiment includes an out-sole 54 and a mid-sole 55, and an in-sole is provided on top of those. In this respect, it is the same as that according to the first embodiment. However, as for training shoes, the sole 53 is thin throughout. Hence, in its specific sole configuration like this or such another, it is different from the shoe according to the first embodiment. Hereinafter, this sole 53 of the shoe according to the second embodiment will be described by emphasizing the points different from the sole 3 according to the first embodiment. Incidentally, some points are not mentioned of the sole 53 according to the second embodiment, because such points are the same, or substantially the same, as the first embodiment.

Specifically, the sole 53 is formed in the heel region F1 so as to have a thickness of 13 mm or below, preferably, 10 mm or below, including a heel protrusion portion 92 (described later). As for training shoes, it is thin so that the wearer can feel the foot bottom nearly barefoot.

The out-sole 54 includes a sole body 91, a heel protrusion portion 92, a foot pressure protrusion strip 93 and a balance protrusion strip 94. In the same way as the first embodiment, it is designed to guide the foot pressure center along the heel protrusion portion 92 and the foot pressure protrusion strip 93.

The bottom surface of the sole body 91 is formed to be substantially flat toward the foot arch region F2 from the heel region F1. It is turned slightly upward from the big toe pad region F3 to the toe region F4 so that the wearer can step forward easily.

Likewise in the sole 53 according to the second embodiment, the sole body 91, the heel protrusion portion 92, the foot pressure protrusion strip 93, and the balance protrusion strip 94 are integrally molded. However, the color, hardness or the like of each portion may be suitably varied according to the type, specification or the like of shoes.

The heel protrusion portion 92 is divided into right and left parts by the foot pressure protrusion strip 93 which extends along substantially the middle part of sole 53 in the width directions. However, in practice, it has the function of cushioning a shock and guiding the foot pressure center in collaboration with the rear end part of the foot pressure protrusion strip 93. The protrusion height of the heel protrusion portion 92 from the sole body 91 is set to be greater than the thickness of the sole body 91. Herein, it is set to about 1.5 to 2.0 times as great as the thickness of the sole body 91.

On the other hand, the foot pressure protrusion strip 93 is formed, as shown in FIG. 8, over the full length of the sole 53. In practice, however, as shown in FIG. 9, its protrusion height from the sole body 91 becomes zero at the part around the root of the fourth toe T. Ahead of this part, by reason of the design, it is disposed beyond grooves inside of the sole body 91. The protrusion height of the foot pressure protrusion strip 93 from the sole body 91 is equivalent to that of the heel protrusion portion 92 in the rear end part of the foot pressure protrusion strip 93. Then, its protrusion becomes gradually lower from a position slightly ahead of the middle of the foot arch region F2. As described above, its protrusion height becomes zero around the root of the fourth toe T. In this way, on its front end side, the protrusion of the foot pressure protrusion strip 93 from the sole body 91 is formed to be gradually lower. This formation of the foot pressure protrusion strip 93 helps reduce the wearer's feeling that something is wrong with the shoes, so that the wearer can feel more comfortable.

Furthermore, in this second embodiment, as shown in FIG. 8, the middle line on the front end of the foot pressure protrusion strip 93 is biased outward (i.e., on the outside in the shoe width directions) from its middle line on the rear end. Hence, the foot pressure protrusion strip 93 is shaped like a crank which is bent within the foot arch region F2. Herein, in this crank part, the foot pressure protrusion strip 93 is wider than any other part thereof. Incidentally, as is not shown in any figure, the foot pressure protrusion strip 93 has a predetermined design groove formed in its bottom surface. This device helps enhance the gripping force or realize such another.

On the other hand, the balance protrusion strip 94 is disposed on each side in the right and left directions of the foot pressure protrusion strip 93. On the right and left sides (i.e., on the inside and outside of the shoe), they are different from each other in the length, the inclination in bottom view, or the like. Specifically, an external balance protrusion strip 94*a* extends substantially in parallel with the foot pressure protrusion strip 93. Its front end is located a little ahead of the middle part of the foot arch region F2. In contrast, an internal balance protrusion strip 94*b* extends so as to incline inward (i.e., the right hand side in the figure) in the sole width directions toward its front end side. Its front end is located slightly behind the big toe pad region F3. In other words, the internal balance protrusion strip 94*b* is longer than the external balance protrusion strip 94*a*. At the same time, different from the external balance protrusion strip 94*a*, it is inclined in bottom view with respect to the foot pressure protrusion strip 93.

In the same way as the foot pressure protrusion strip 93, the external and internal balance protrusion strips 94 are formed so that the protrusion of each front end part from the sole body 91 becomes gradually lower. This protrusion is designed to be lower by a reduction rate which is greater than the reduction rate of the foot pressure protrusion strip 93.

Herein, special notice should be taken of the following point. In the first embodiment described earlier, the balance protrusion strip 44 protrudes lower than the foot pressure protrusion strip 43. Thus, the bottom surface of the balance protrusion strip 44 lies in a position recessed a little above the plane which includes the bottom surface of the foot pressure protrusion strip 43. In contrast, in the second embodiment, as shown in FIG. 10, the protrusion height of the balance protrusion strip 94 from the sole body 91 is substantially equal to the protrusion height of the foot pressure protrusion strip 93. Hence, the bottom surface of the balance protrusion strip 94 is substantially flush with the bottom surface of the foot pressure protrusion strip 93.

In this way, the bottom surface of the balance protrusion strip 94 is on the same plane with the bottom surface of the foot pressure protrusion strip 93. Therefore, at an early stage when a shoe begins to touch the ground in a walking or running motion and a person who wears the shoes tends to be relatively unstable and lose the balance, the shoe can come into contact, over a relatively wide area, with the ground, so that the balance becomes stable earlier. At the same time, the feeling that something is wrong with the shoes can be reduced, so that the person can feel more comfortable with the shoes on.

As shown in FIG. 10, both the balance protrusion strip 94 and the foot pressure protrusion strip 93 have a rectangular shape.

The shoe with such a configuration according to the second embodiment is also capable of obtaining the same advantages as the first embodiment. In addition, in the case where a person wear the pair of shoes and in the case where this person wears another pair of shoes, the distances by which the person moves are measured and compared. Its result is given in the following tables.

TABLE 1

| SUBJECT | HEIGHT (cm) | WEIGHT (kg) | AGE (YEARS) |
|---|---|---|---|
| A | 173 | 65 | 26 |
| B | 175 | 60 | 23 |
| C | 186 | 80 | 25 |
| D | 171 | 70 | 25 |
| E | 171 | 83 | 27 |
| F | 178 | 81 | 39 |
| G | 174 | 65 | 39 |
| AVERAGE | 175.4 | 72 | 29.1 |

In this comparison test, as shown in Table 1, seven male subjects (whose average height: 175.4 cm, average weight: 72 kg, average age: 29.1 years old) who are sound in mind and body wear the pair of shoes (i.e., embodiment article) according to the second embodiment and a pair of shoes (i.e., comparison article) which they are accustomed to wear. After they have walked for thirty minutes, their movement distances for each pair of shoes are compared. Incidentally, in this comparison test, the wear order of each pair of shoes, in other words, whether they wear the embodiment product first or later, differ according to the subjects. This contributes toward reducing, to a minimum, the influence of physical fatigue, the practice of a motion for this test or the like on a test result.

TABLE 2

| SUBJECT | EMBODIMENT ARTICLE | COMPARISON ARTICLE |
|---|---|---|
| A | 3226 | 2969 |
| B | 2460 | 2374 |
| C | 2730 | 2585 |
| D | 2783 | 2584 |
| E | 3290 | 3095 |
| F | 3647 | 3117 |
| G | 2817 | 2603 |
| AVERAGE | 2993.3 | 2761.0 |

As can be seen from Table 2 described above, in terms of all the subjects, in the case where the subjects wear the pair of shoes (i.e., embodiment article) according to the second embodiment, their movement distances are longer than those in the case where they wear the pair of shoes (i.e., comparison article) which they are accustomed to wear. Specifically, in the case where they walk with the embodiment article on, the average movement distance is 2993.3 meters. In contrast, in the case where they walk with the comparison article on, the average movement distance is 2761.0 meters. This result indicates that the movement distance when they walk with the embodiment article on is longer by 232.3 meters.

In this way, all the wearer of the embodiment article move by such a longer distance than in the case of the comparison article. This is because when a person who wears the embodiment article walks or runs, the foot pressure center is guided along a predetermined foot pressure center route from the heel toward the vicinity of the root of the fourth toe. Therefore, regardless of the wearer's personal habit or the like, the wearer is prompted to make an optimum walking motion. As a result, the wearer tends to walk stably, smoothly and swiftly.

(Other Embodiments)

The out-sole and the shoe provided with the out-sole which are described so far are an exemplary sole and shoe according to the present invention. The specific configuration or the like of the sole and shoe may be suitably varied without departing from the scope of the present invention. Hence, variations will be described below.

(1) In the above described first and second embodiments, the foot pressure protrusion portion is configured as the protrusion strip 43 which is continuously formed along the foot pressure center route from the heel protrusion portion 42. However, the specific configuration of the foot pressure protrusion portion is not especially limited, as long as the foot pressure center is guided from the heel toward the vicinity of the root of the fourth toe T.

Figure 12:
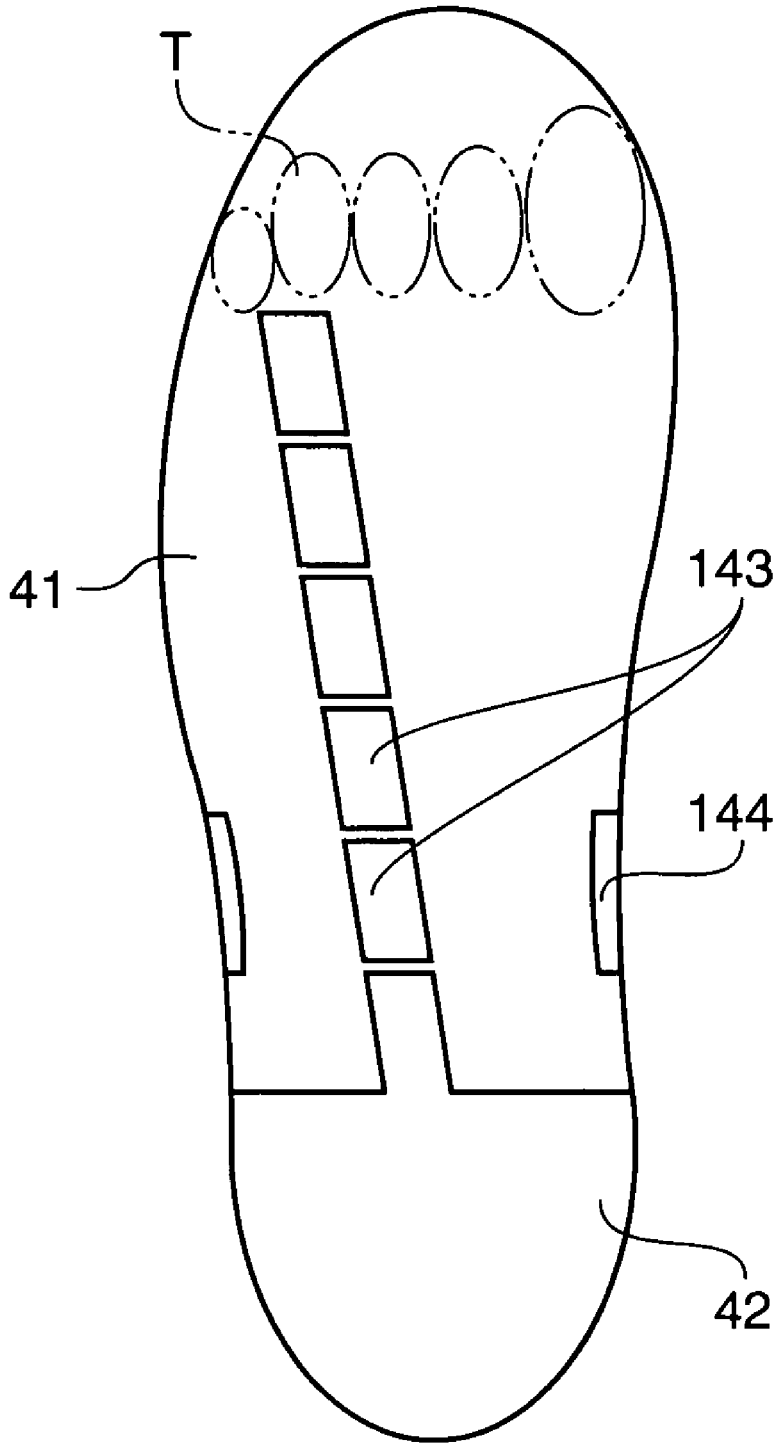
FIG. 12 is a typical bottom view of a sole according to a third embodiment of the present invention.

FIG. 12 is a schematic bottom view of a sole according to a third embodiment. In this third embodiment, the foot pressure protrusion portion and the balance protrusion portion differ in specific configuration from the first embodiment. Specifically, in the third embodiment, the foot pressure center includes a plurality of unit foot pressure protrusion portions 143 which line up via a predetermined gap between them along the foot pressure center route extending from the heel toward the fourth toe T. The shape of each unit foot pressure protrusion portion 143 is not especially limited, but in the third embodiment, it has a quadrangular shape in bottom view. Furthermore, in the third embodiment, each unit foot pressure protrusion portion 143 has a substantially equal size. However, needless to say, their sizes may also be different from each other. Moreover, the gap width between the unit foot pressure protrusion portions 143 is not especially limited, but in order to guide the foot pressure center smoothly, preferably, it may be set to be smaller than the length of each unit foot pressure protrusion portion 143.

In addition, in the third embodiment, a balance protrusion portion 144 is provided independently of the heel protrusion portion 42. The balance protrusion portion 144 is a protrusion strip which is formed over a predetermined length near the rear end of the foot arch region F2 of the sole body 41. In terms of the balance protrusion portion 144, its specific shape is not especially limited, for example, it may also include unit protrusion portions which are scattered at each side edge of the sole body 41 and have a circular shape in bottom view.

By the way, in response to the motion of the foot region which is caused by a walking or running motion, preferably, the sole body 41 may be flexibly bent. In this respect, in the above described first and second embodiments, the deformation of the sole body 41 can be somewhat kept under control. In contrast, in the sole according to the third embodiment, the foot pressure protrusion portion is divided in its longitudinal directions and includes the plurality of unit foot pressure protrusion portions 143 which line up in the same directions. Therefore, the foot pressure protrusion portion helps restrain the sole body 41 far more strikingly from being bent. This makes it possible to make a smoother walking or running motion so that a person who wears the pair of shoes 1 can feel more comfortable.

Figure 13:
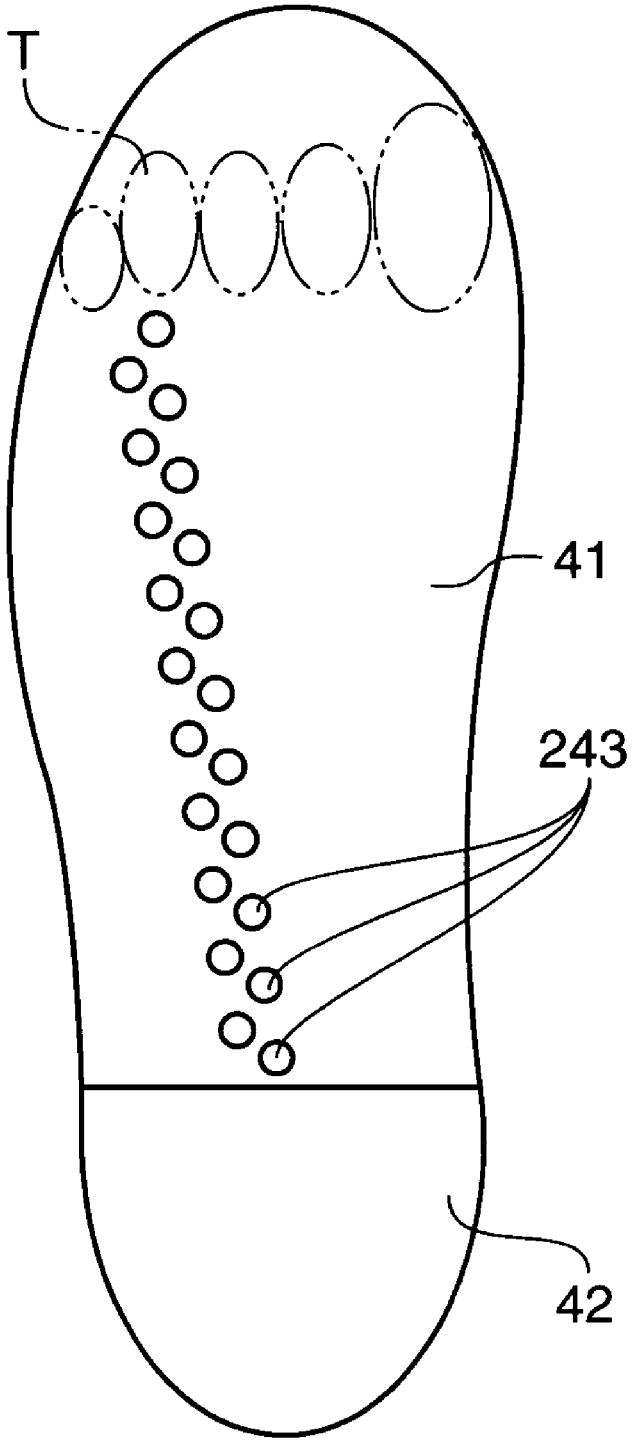
FIG. 13 is a typical bottom view of a sole according to a fourth embodiment of the present invention.

On the other hand, FIG. 13 is a schematic bottom view of a sole according to a fourth embodiment of the present invention. In the fourth embodiment alike, the specific configuration of the foot pressure protrusion portion is different from each embodiment described earlier. Specifically, a large number of flat and columnar unit foot pressure protrusion portions 243 are scattered along a foot pressure center route L extending from the heel up to the fourth toe. The unit foot pressure protrusion portions 243 may make up the foot pressure protrusion portion.

(2) In the above described first and second embodiments, the foot pressure protrusion strip 43 is formed into a belt like shape having a fixed width. However, it may be gradually narrower from the heel protrusion portion 42 toward the fourth toe T. Besides, the foot pressure protrusion strip 43 may also be narrower step by step in the longitudinal directions. In addition, the bottom surface of the foot pressure protrusion strip 43 may also be formed as narrow as possible so that it is formed into a triangular shape in lateral sectional view.

(3) In the above described first and second embodiments, the foot pressure protrusion strip 43 may also be provided with a pin for a spike attached to its bottom surface. This spike pin may be fixedly attached, but preferably, it may be detachably attached. According to this configuration, if such a pin is worn down or damaged, this pin can be replaced, thus making it handier.

(4) In the above described first and second embodiments, the heel protrusion portion 42, the foot pressure protrusion strip 43 and the balance protrusion strip 44 are united with the sole body 41. However, the protrusion portions 42, 43, 44 may be attached to the sole body 41 so that each can be detachably attached. According to this configuration, if each protrusion portion 42, 43, 44 wears down, they can be easily replaced, thus making it handier.

(5) In the above described first and second embodiments, the foot pressure protrusion strip 43 is provided so that its front end is located slightly behind the root of the fourth toe T. However, its front end position can be freely varied within a range from the root of the fourth toe T to around the place where the width of the foot pressure protrusion strip 437 reaches the fourth toe T.

Furthermore, in terms of the foot pressure protrusion strip 43, its front end may further extend so as to reach the tip of the fourth toe T from the part corresponding to the root of the fourth toe T. The point is that the foot pressure protrusion strip 43 extends at least up to the vicinity of the root of the fourth toe T. However, in the above described first and second embodiments, the front end of the foot pressure protrusion strip 43 is located around the root of the fourth toe T. Therefore, the foot pressure center can move easily from the fourth toe T to the big toe pad, so that a smoother and swifter walking or running motion can be made.

(6) In the above described first and second embodiments, the balance protrusion strip 44 is formed so as to continue to the heel protrusion portion 42, and its front end is located at a substantially middle part of the foot arch region F2. However, the balance protrusion strip 44 may also be provided independently of the heel protrusion portion 42. Besides, its front end may also reach the front end of the foot arch region F2, or a predetermined position of the big toe pad region F3.

(7) In each embodiment described above, as the foot pressure guidance portion, there is provided the foot pressure protrusion portion (i.e., the foot pressure protrusion strip 43). However, the foot pressure guidance portion is not necessarily required to protrude from the sole body 41. Specifically, if the part of the out-sole that is along the foot pressure center route is provided with a hard route portion which is harder than any other part thereof, then the foot pressure center can be guided along the hard route portion.

However, as is the case with each embodiment described above, if the foot pressure guidance portion is defined by the foot pressure protrusion portion, the foot pressure center can be guided more certainly and smoothly.

Furthermore, in each of the above described embodiments, the out-sole 4, 54 is formed to be equivalent to the bottom shape of the shoe 1. Then, the out-sole 4, 54 is provided with the foot pressure protrusion strip 43, 93, the heel protrusion portion 42, 92 and the like. However, the shape of such an out-sole is not especially limited. Hence, for example, an out-sole may also be formed into a shape which corresponds to a heel protrusion portion, a foot pressure protrusion strip and a balance protrusion strip. In this case, the out-sole is placed under the bottom surface of a mid-sole and joined to it, so that the heel protrusion portion, foot pressure protrusion strip and balance protrusion strip protrude from the bottom surface of the mid-sole. Thereby, the protrusion portions are each formed on the bottom surface of a sole body.

In brief, the sole body is not limited to the out-sole in each of the above described embodiments. Hence, the sole body may also be configured by combining an out-sole and a mid-sole.

Moreover, an inner sole may also be configured as the sole body. Even in this case, the inner sole is formed with a foot pressure protrusion portion. Therefore, the foot pressure of a wearer converges on the part which corresponds to the foot pressure protrusion portion. This makes it possible to obtain the same advantage.

(8) In the above described first and second embodiments, the sole body is described as the sole body 41, 91 provided in the out-sole 4, 54. However, it is not limited to the one provided in the out-sole 4, 54, and thus, it may also be a sole body provided in a mid-sole or an in-sole. In other words, the foot pressure guidance portion such as a foot pressure protrusion strip is not the one provided only in an out-sole, but instead of this configuration, it may also be the one provided in a mid-sole or an in-sole. Particularly, in the case where a foot pressure protrusion strip is provided in an in-sole, for example, the in-sole is formed with: a sole body which is formed so as to correspond to the foot region; and a wide area protrusion portion, the foot pressure protrusion strip and a balance protrusion strip which are formed on this sole body's bottom surface. Then, this in-sole is placed on top of a mid-sole so that a sole can be easily formed.

(9) In the above described first and second embodiments, the front end part of the sole body 41, 91 is turned slightly upward. However, such a sole body may also be flat over its full length.

(10) As already described, the wide area protrusion portion is not limited to the heel protrusion portion, for example, it may be expanded to the foot arch region F2. However, in the case where the wide area protrusion portion is configured like that according to the first and second embodiments, its thickness reduction effect contributes to making a shoe lighter. Simultaneously, such a shoe becomes more flexible so that a person who wears this can feel more comfortable.

(11) In addition, in each embodiment described above, the description is made to the case where the wide area protrusion portion such as the heel protrusion portion is provided. However, the wide area protrusion portion may be suitably removed, and in that case, using the foot pressure protrusion portion, the foot pressure center can be guided from the heel to the vicinity of the root of the fourth toe.

(Summary of Features of the Present Invention)

Specifically, in order to solve the above described problems, a sole according to the present invention comprises: a sole body which forms a bottom part of a footwear; and a foot pressure guidance portion which is provided in this sole body, and guides a foot pressure center corresponding to the center of a pressure applied to a bottom of a foot that moves when a person walks or runs, along a predetermined foot pressure center route from the heel toward the vicinity of the root of the fourth toe.

According to the present invention, the foot pressure guidance portion is provided in the sole body. Accordingly, the foot pressure center can be guided along the predetermined desirable foot pressure center route from the heel toward the vicinity of the root of the fourth toe when the person walks or runs. Specifically, regardless of the personal habit or the like of a wearer of a footwear provided with such soles, when the wearer walks or runs, the foot pressure center can be guided from the heel to the vicinity of the root of the fourth toe. Thus, the wearer can move the thighs back and forth inward using the hip joint spontaneously and swing the legs and the foot bottom parts reflexively without tensing the muscles unnecessarily. This facilitates an optimum walking or running motion. Therefore, the burden imposed on the skeletal structure or muscles of the lower half body becomes lighter, and the wearer can walk or run stably, smoothly and swiftly, regardless of the habit of a walking or running motion.

In addition, moving the foot pressure center along the arrow P in FIG. 4 prompts the foot muscles to become active well. This muscles activity can stimulate a brain to thereby improve a paralysis.

In the foot pressure guidance portion, its specific disposition place is not limited, so long as it lies between the ground and the bottom of each foot of a person who wears the footwear provided with this sole. For example, it may also be provided on a top surface or the inside of the sole body. However, such a foot pressure guidance portion should be rather disposed on the side where it comes into contact with the ground. Hence, it is preferable that it be disposed on a bottom surface of the sole body (claim 2).

The foot pressure guidance portion may be configured so that the foot pressure concentrates and acts on the foot pressure center route. For example, it may be configured so that the foot pressure concentrates and acts on the foot pressure center route by making the foot pressure center route of a material relatively harder than the material around it. However, preferably, such a foot pressure guidance portion may include: a wide area protrusion portion which protrudes in a predetermined area including at least the bottom surface of a heel region of the sole body; and a foot pressure protrusion portion which protrudes from the sole body, along the foot pressure center route from this wide area protrusion portion (claim 3).

According to this configuration, the wide area protrusion portion protrudes from the bottom surface of the heel region of the sole body. Therefore, in a walking or running motion, first, this wide area protrusion portion is prompted to land on the ground. This wide area protrusion portion protrudes in a predetermined area including the bottom surface of the heel region. Thereby, the foot pressure center can act first on the heel region. Sequentially, the foot pressure protrusion portion comes into contact with the ground, so that the foot pressure can converge and act on this foot pressure protrusion portion. This makes it possible to concentrate the foot pressure center on the foot pressure center route. Therefore, the foot pressure guidance portion may be configured, using a simple configuration where the foot pressure protrusion portion protrudes from the bottom surface of the sole body.

In addition, this foot pressure protrusion portion protrudes on the foot pressure center route from the wide area protrusion portion toward the vicinity of the root of the fourth toe. Therefore, after the foot pressure center moves toward around the root of the fourth toe, it passes through the big toe pad and the first toe (or big toe). Hence, such a walking or running motion becomes possible. When a person walks or runs, the person can move the thighs and the lower limbs back and forth inward, using the efficient bone structure of the pelvis and the hip joint. Thus, the burden imposed on the skeletal structure of the lower half body or muscles becomes lighter, so that the legs and loins can be effectively prevented from being hurt. Incidentally, the vicinity of the root of the fourth toe spreads in the sole length directions larger than in the sole width directions. The heel section may be on a position (e.g., the position corresponding to the rear end part of the big toe pad) which is slightly close to the heel from the position corresponding to the root of the fourth toe. On the other hand, the toe section covers a portion which corresponds to the vicinity of the front end part of the fourth toe.

Herein, the front end of the foot pressure protrusion portion (i.e., the foot pressure guidance portion) front end is located at the toe part around the root of the fourth toe, so that the center of gravity can be stably moved. Specifically, if the front end of the foot pressure protrusion portion is located further outward (e.g., outward from the fifth toe) from around the root of the fourth toe, then the force which will bring the person's body down inward acts too early. Thereby, a foot joint and a hip joint are bent outward and a stress is given on the joint region of a toe, a foot joint or the like, thus causing hallux valgus. On the other hand, if the front end of the foot pressure protrusion portion is disposed inward (e.g., at the toe part around the second toe) from around the root of the fourth toe, then the force which will bring the person's body down outside acts greatly. Thereby, oppositely, the center of gravity becomes unstable, like swaying right and left, and a stress opposite to the above described stress on the joint region is applied to the joint region. Therefore, the front end of the foot pressure protrusion portion needs to be located at the toe part around the root of the fourth toe, so that the center of gravity can be stably moved and the stress on the joint region can be lightened or got rid of.

In this case, the foot pressure protrusion portion may also be formed by a protrusion strip which continues along the foot pressure center route from the wide area protrusion portion (claim 4). Alternatively, the foot pressure protrusion portion may also include a plurality of unit protrusion portions on the foot pressure center route (claim 7).

According to the former configuration, the foot pressure protrusion portion can be restrained as much as possible from being deformed, and thus, the foot pressure center can be smoothly moved along this foot pressure protrusion portion. This helps control the movement locus of the foot pressure center more appropriately. On the other hand, according to the latter configuration, when a person walks or runs, the shape of the sole body can be relatively easily changed. Hence, the person can wear footwear provided with such soles more comfortably.

In this case, the foot pressure protrusion portion may become gradually narrower toward its front end from the base end, or narrower step by step. However, it is preferable that the foot pressure protrusion portion be narrower than the wide area protrusion portion (claim 5). Besides, preferably, the foot pressure protrusion portion may be formed into a belt like shape having a substantially fixed width along its longitudinal directions (claim 6).

According to this configuration, the foot pressure center can be certainly and correctly moved along the foot pressure center route formed by this foot pressure protrusion portion. This helps keep the sway of the center of gravity in the right and left directions properly under control.

The above described sole body, wide area protrusion portion and foot pressure protrusion portion may be united (claim 8). Or, at least one of the wide area protrusion portion and the foot pressure protrusion portion may be detachably attached to the sole body (claim 9).

According to the former configuration, the wide area protrusion portion and the foot pressure protrusion portion can be certainly prevented from unexpectedly falling out of the sole body. According to the latter configuration, the wide area protrusion portion or the foot pressure protrusion portion which has been used and worn down can be replaced, thus making it handier.

The foot pressure protrusion portion may extend from an edge part of the wide area protrusion portion in the width directions. However, it is preferable that the foot pressure protrusion portion extend from a middle part of the wide area protrusion portion in the width directions (claim 10).

According to this configuration, the foot pressure center can be smoothly moved from the wide area protrusion portion to the foot pressure protrusion portion.

The protrusion height of the foot pressure protrusion portion from the sole body may be fixed over its full length. However, preferably, the protrusion height of the foot pressure protrusion portion from the sole body may become gradually smaller toward its front end from the base end (claim 11).

According to this configuration, the center of gravity can be smoothly moved in the front and back directions. This makes it possible to make a smoother and swifter walking or running motion.

In the present invention, it is preferable that the wide area protrusion portion include: a heel protrusion portion which protrudes so as to correspond to the heel region of the sole body; and a balance protrusion portion which protrudes from the bottom surface of the sole body on each side of the foot pressure protrusion portion in the width directions and restrains an inclination in the width directions by touching the ground (claim 12).

Specifically, while a person is walking at a constant pace, the foot pressure center can be harmoniously and smoothly moved along this protrusion portion and the foot pressure protrusion portion. However, the person tends to lose the balance when stopping, while walking at or below a predetermined pace, and at another such time. According to this configuration, therefore, the balance protrusion portion is provided for returning the foot pressure center to the foot pressure center route. Thereby, while walking at a slow pace or at such another, the person can make an optimum walking motion or the like.

In this case, this balance protrusion portion may be discontinuously provided. However, preferably, the balance protrusion portion may continuously extend over a predetermined length from the heel protrusion portion (claim 13).

According to this configuration, at an early stage when a shoe begins to touch the ground and the wearer tends to lose the balance comparatively, the movement of the foot pressure center can be effectively corrected.

Furthermore, in this case, it is preferable that the bottom surface of the balance protrusion portion be substantially flush with the bottom surface of the foot pressure protrusion portion (claim 14).

Specifically, at an early stage when a shoe begins to touch the ground in a walking or running motion, a person who wears the shoes tends to be relatively unstable and lose the balance. Therefore, if both bottom surfaces of the balance protrusion portion and the foot pressure protrusion portion are on one and the same plane, then at an early stage when the sole starts to touch the ground, it can come into contact, over a relatively wide area, with the ground, so that the balance becomes stable earlier.

Oppositely, first, in order to bring the foot pressure protrusion portion into contact with the ground and concentrate the foot pressure actively on the foot pressure protrusion portion, preferably, the protrusion height of the balance protrusion portion from the sole body may be smaller than the protrusion height of the foot pressure protrusion portion (claim 15).

On the other hand, a footwear according to the present invention includes the sole according to any one of claims 1 to 15.

According to the present invention, when a person just wears it, the person can make an optimum walking or running motion. Thereby, the burden imposed on the skeletal structure or muscles of the lower half body becomes lighter to the utmost, so that the person can make a smooth and quick motion.

As described so far, in the sole and footwear according to the present invention, when a person walks or runs, the foot pressure center can be guided along a predetermined foot pressure center route from the heel toward the vicinity of the root of the fourth toe. Specifically, regardless of the personal habit or the like of a wearer of footwear provided with such soles, when the wearer walks or runs, the foot pressure center can be guided from the heel to the vicinity of the root of the fourth toe. Hence, such a wearer can make an optimum walking or running motion. Therefore, the burden imposed on the skeletal structure or muscles of the legs and loins becomes lighter, so that the wearer can walk or run stably, smoothly and swiftly, regardless of how to walk or run.

The invention claimed is:

1. A sole comprising:

a sole body which forms a bottom part of a footwear, the sole body having opposite front and rear ends, a fourth toe supporting part in proximity to the front end for supporting a vicinity of a root of the fourth toe of a wearer of the footwear and a heel supporting part in proximity to the rear end for supporting a heel of the wearer; and a foot pressure guidance portion provided in the sole body to guide a foot pressure center corresponding to a center of a pressure applied to a bottom of a foot from the heel supporting part toward the fourth toe supporting part when the wearer walks or runs, the foot pressure guidance portion having at least one physical characteristic that is different from other portions of the sole body and being so narrow that only the foot pressure guidance portion guides the foot pressure center, the physical characteristic of the foot pressure guidance portion that is different from other portions of the sole body including: a wide area protrusion portion provided on an area including at least the heel supporting part; and a foot pressure protrusion portion extending from the wide area protrusion portion toward the fourth toe supporting part, the foot pressure protrusion portion extending from a widthwise middle part of a forward edge of the wide area protrusion portion to the fourth toe supporting part.

2. A footwear including the sole according to claim 1.

3. A sole comprising:

a sole body that forms a bottom part of a footwear, the sole body having a variable width; and a foot pressure guidance portion provided in the sole body for guiding a foot pressure center corresponding to a center of pressure applied to a bottom of a foot that moves when a wearer walks or runs, the foot pressure guidance portion extending from a heel supporting part for supporting a heel of the wearer to a fourth toe supporting part for supporting a vicinity of the root of the fourth toe of the wearer along a line passing a center of the heel supporting part and the fourth toe supporting part, and the foot pressure guidance portion having a uniform width smaller than the variable width of the sole body and having at least one physical characteristic that is different from other portions of the sole body.

4. The sole according to claim 3, wherein the physical characteristic of the foot pressure guidance portion that is different from other portions of the sole body comprises protruding the foot pressure guidance portion farther down than laterally adjacent areas of the sole body.

5. A footwear including the sole according to claim 4.

6. The sole according to claim 3, wherein the foot pressure guidance portion includes: a wide area protrusion portion provided on an area including at least the heel supporting part; and a foot pressure protrusion portion extending from the wide area protrusion portion toward the fourth toe supporting part.

7. A footwear including the sole according to claim 6.

8. The sole according to claim 6, wherein the foot pressure protrusion portion includes a protrusion strip which extends from the wide area protrusion portion toward the vicinity of the root of the fourth toe supporting part.

9. A footwear including the sole according to claim 8.

10. The sole according to claim 8, wherein the foot pressure protrusion portion is narrower than the wide area protrusion portion.

11. A footwear including the sole according to claim 10.

12. The sole according to claim 6, wherein the sole body, the wide area protrusion portion and the foot pressure protrusion portion are united.

13. The sole according to claim 6, wherein at least one of the wide area protrusion portion and the foot pressure protrusion portion is detachably attached to the sole body.

14. The sole according to claim 6, wherein the foot pressure protrusion portion extends from a widthwise middle part of a forward edge of the wide area protrusion portion to the fourth toe supporting part.

15. The sole according to claim 6, wherein the protrusion height of the foot pressure protrusion portion from the bottom surface of the sole body becomes gradually smaller toward the front end from the rear end thereof.

16. The sole according to claim 6, wherein the wide area protrusion portion includes: a heel protrusion portion provided on the heel supporting part; and a balance protrusion portion provided on each side of the foot pressure protrusion portion in the width directions and restrains an inclination in the width directions upon touching the ground.

17. The sole according to claim 16, wherein the balance protrusion portion continuously extends over a length from the heel protrusion portion that is less than an extending length of the foot pressure protrusion portion.

18. The sole according to claim 17, wherein the bottom surface of the balance protrusion portion is substantially flush with the bottom surface of the foot pressure protrusion portion.

19. The sole according to claim 17, wherein the protrusion height of the balance protrusion portion from the sole body is smaller than the protrusion height of the foot pressure protrusion portion.

20. The sole according to claim 3, wherein the physical characteristic of the foot pressure guidance portion that is different from other portions of the sole body is a hardness of the foot pressure guidance portion.

* * * * *